US010399745B2

(12) United States Patent
Fang

(10) Patent No.: US 10,399,745 B2
(45) Date of Patent: Sep. 3, 2019

(54) ENVIRONMENTALLY-FRIENDLY, ANTI-CONTAMINATION SUCTION-NOZZLE BEVERAGE CUP COVER AND PROCESSING METHOD THEREOF

(71) Applicant: Yuhao Fang, Zhejiang (CN)

(72) Inventor: Yuhao Fang, Zhejiang (CN)

( * ) Notice: Subject to any disclaimer, the term of this patent is extended or adjusted under 35 U.S.C. 154(b) by 0 days.

(21) Appl. No.: 15/744,775

(22) PCT Filed: Jun. 8, 2016

(86) PCT No.: PCT/CN2016/085272

§ 371 (c)(1),
(2) Date: Jan. 13, 2018

(87) PCT Pub. No.: WO2017/181509

PCT Pub. Date: Oct. 26, 2017

(65) Prior Publication Data

US 2018/0208366 A1 Jul. 26, 2018

(30) Foreign Application Priority Data

Apr. 18, 2016 (CN) ..... 2016 1 0238544

(51) Int. Cl.
*B65D 25/46* (2006.01)
*A45F 3/18* (2006.01)
(Continued)

(52) U.S. Cl.
CPC ..... *B65D 25/465* (2013.01); *A45F 3/18* (2013.01); *A47G 19/22* (2013.01);
(Continued)

(58) Field of Classification Search
CPC .... B65D 51/242; B65D 51/24; B65D 23/106; B65D 23/108; B65D 23/10; B65D 43/26;
(Continued)

(56) References Cited

U.S. PATENT DOCUMENTS 5,282,541 A * 2/1994 Chen ..... A47G 19/2266 215/12.1
9,844,285 B2 * 12/2017 Hoskins ..... A47G 19/2266
(Continued)

FOREIGN PATENT DOCUMENTS

CN 101108525 A 1/2008
CN 201418476 Y 3/2010
(Continued)

*Primary Examiner* — Robert J Hicks
(74) *Attorney, Agent, or Firm* — Muncy, Geissler, Olds & Lowe, P.C.

(57) ABSTRACT

An environmentally-friendly, anti-contamination suction-nozzle beverage cup cover includes a cover body connected to a beverage cup and formed with a suction nozzle mounting chamber at the top of the cover body, a tube insertion hole formed in the mounting chamber, a suction nozzle disposed in the tube insertion hole, a swing sleeve provided outside the suction nozzle and formed with a swing pin fitted into the swing holes, swing holes formed in both sides of the mounting chamber, a connecting ear formed at one side of the cover body, a clamp and a safety catch disposed on and fixed with the connecting ear via a shaft, a return ejector spring disposed in the clamp, a shield disposed on the cover body and in contact with the head of the suction nozzle. The head of the shield is formed with a clamp rib that matches the clamp.

3 Claims, 5 Drawing Sheets

(51) Int. Cl.

| | |
|---|---|
| ***A47G 19/22*** | (2006.01) |
| ***B65D 25/28*** | (2006.01) |
| ***B65D 47/06*** | (2006.01) |
| ***B65D 47/20*** | (2006.01) |
| *B65D 43/26* | (2006.01) |

(52) U.S. Cl.

CPC ..... *A47G 19/2266* (2013.01); *B65D 25/2808* (2013.01); *B65D 47/066* (2013.01); *B65D 47/2031* (2013.01); *B65D 43/26* (2013.01); *B65D 2205/02* (2013.01); *B65D 2547/063* (2013.01)

(58) Field of Classification Search

CPC ..... B65D 25/465; B65D 25/46; B65D 25/42; B65D 25/40; B65D 25/525; B65D 25/48; B65D 41/0485; B65D 47/063; A47G 19/2272; A47G 19/2222; A45F 3/18; A45F 3/16

USPC ..... 215/389, 388, 387, 396, 229, 228, 305, 215/295; 220/759, 756, 710.5, 709, 708, 220/705, 212.5, 212, 264, 263, 262; 222/570, 568, 567, 566, 529, 528, 527, 222/531

See application file for complete search history.

(56) References Cited

U.S. PATENT DOCUMENTS

| | | | | |
|---|---|---|---|---|
| 2012/0187075 | A1* | 7/2012 | El-Saden | B65D 47/066 215/389 |
| 2012/0312832 | A1* | 12/2012 | Lane | B65D 47/066 220/833 |
| 2014/0175098 | A1 | 6/2014 | Lane | |
| 2017/0021982 | A1* | 1/2017 | Choi | A47G 19/2266 |

FOREIGN PATENT DOCUMENTS

| | | | |
|---|---|---|---|
| CN | 201641374 | U | 11/2010 |
| CN | 202287502 | U | 7/2012 |
| CN | 204071515 | U | 1/2015 |
| CN | 204292793 | U | 4/2015 |
| CN | 205696382 | U | 11/2016 |

* cited by examiner

ENVIRONMENTALLY-FRIENDLY, ANTI-CONTAMINATION SUCTION-NOZZLE BEVERAGE CUP COVER AND PROCESSING METHOD THEREOF

FIELD OF THE INVENTION

The present invention relates to beverage cup cover, and in particular to an environmentally-friendly, anti-contamination suction-nozzle beverage cup cover and a processing method of the beverage cup cover.

BACKGROUND

A beverage cup mainly consists of a cup cover and a cup body, for traditional beverage cup, when drinking, one opens the cup cover and uses his mouth to directly drink a beverage (mainly referring to water) at a cup port. However, with the constant need of traveling outside, it is easy to choke a throat directly with a cup when drinking, therefore, in recent years, a drinking straw or a suction nozzle is used for drinking the beverage, when one drinks the beverage with the drinking straw or the suction nozzle, he utilizes an oral suction of his mouth to drink the beverage into his mouth via the drinking straw or the suction nozzle, thus avoiding choking his throat, therefore, one can also drink the beverage when walking. For a suction-nozzle beverage cup in the prior art, a suction nozzle is provided in the cup cover, when in use, one uses his finger to pull up the suction nozzle to drink the beverage, and then similarly using the finger to press down the suction nozzle into the cup cover to fix the suction nozzle, therefore, when the suction nozzle is pressed and cocked, the bacteria, dirt and the like on the finger will be brought to the suction nozzle by the finger and then inhaled into an oral cavity, which easily causes the infection of various germs.

SUMMARY

The purpose of the present invention is to overcome the shortcomings of the prior art and to provide an environmentally-friendly, anti-contamination suction-nozzle beverage cup cover of which a suction nozzle is provided with an anti-contamination device, without touching the suction nozzle with fingers when opening and closing, to avoid the transmission of germs, and to more conveniently use.

Another of the present invention is to provide a processing method of an environmentally-friendly, anti-contamination suction-nozzle beverage cup cover.

An environmentally-friendly, anti-contamination suction-nozzle beverage cup cover of the present invention has the following technical solution: the cup comprises a cover body, with the lower part of the cover body being connected to a beverage cup, the cover body being formed with a hand ring, the top of the cover body being formed with a suction nozzle mounting chamber, a tube insertion hole being formed in the suction nozzle mounting chamber, and a suction nozzle being disposed in the tube insertion hole, characterized in that a swing sleeve is provided outside the suction nozzle made of silicone, swing holes are formed in both sides of the mounting chamber, the swing sleeve is formed with a swing pin, the swing pin matches the swing hole, a connecting ear is formed at one side of the cover body, a clamp and a safety catch are disposed on the connecting ear, the clamp and the safety catch are fixed with the connecting ear via a small shaft, a return ejector spring is disposed in the clamp, a shield is disposed on the cover body, a connecting hole is formed on the hand ring, two connecting feet are formed at the rear part of the shield, a connecting pin is formed on the connecting feet, the connecting pin matches the connecting hole, the inner wall of the shield is in contact with the head of the suction nozzle, the head of the shield is formed with a clamp rib, the clamp rib matches the clamp, the safety catch is in contact with the outer wall of the head of the shield, an air inlet hole is formed in the suction nozzle mounting chamber, the suction nozzle is formed with at a tenon, the tenon matches the air inlet hole.

The present invention discloses an environmentally-friendly, anti-contamination suction-nozzle beverage cup cover, comprising a cover body, with the lower part of the cover body being connected to a beverage cup, the cover body being formed with a hand ring, the top of the cover body being formed with a suction nozzle mounting chamber, a tube insertion hole being formed in the suction nozzle mounting chamber, and a suction nozzle being disposed in the tube insertion hole, characterized in that a swing sleeve is provided outside the suction nozzle made of silicone, swing holes are formed in both sides of the mounting chamber, the swing sleeve is formed with a swing pin, the swing pin matches the swing hole, a connecting ear is formed at one side of the cover body, a clamp and a safety catch are disposed on the connecting ear, the clamp and the safety catch are fixed with the connecting ear via a small shaft, a return ejector spring is disposed in the clamp, a shield is disposed on the cover body, a connecting hole is formed on the hand ring, two connecting feet are formed at the rear part of the shield, a connecting pin is formed on the connecting feet, the connecting pin matches the connecting hole, the inner wall of the shield is in contact with the head of the suction nozzle, the head of the shield is formed with a clamp rib, the clamp rib matches the clamp, the safety catch is in contact with the outer wall of the head of the shield. when in use, the safety catch is first is pulled down so that the safety catch and the head of the shield are disengaged, a block fastener is pressed, the clamp is subject to a spring force so that the clamp and the clamp rib are disengaged, the elasticity of a silicone suction nozzle is utilized to open the shield. the silicone suction nozzle is tipped upward with the swinging of the swinging sleeve, one can easily drink the beverage without having to pull his finger up, when finishing the use, one presses with his finger on the outer wall of the shield, the shield covers the outside of the silicone suction nozzle, the suction nozzle is subject to the pressure of the shield, and is pressed into the suction nozzle mounting chamber in the pressing direction of the shield, the drinking straw under the suction nozzle is pressed and deformed to be closed, so that the beverage in the beverage cup does not flow out, when the head of the shield is pressed to be in contact with the clamp, the clamp is subject to the spring force of the return ejector spring to block the head of the shield, the safety catch is fastened, when one does not drink water, he can prevent the shield from being accidentally bounced. when the cup cover is opened and closed, the finger is not in contact with the suction nozzle, this not only facilitates the use, but also avoids the infection of bacteria and achieve the purpose of health and environmental protection. an air inlet hole is formed in the suction nozzle mounting chamber, the suction nozzle is formed with at a tenon, the tenon matches the air inlet hole, With the air inlet hole, the beverage is easy to flow out when being drunk.

For an environmentally-friendly, anti-contamination suction-nozzle beverage cup cover of the present invention, a positioning convex piece is formed on the hand ring, the positioning convex piece is in contact with the connecting feet of the rear part of the shield, after the shield is opened, the positioning convex piece positions and sticks the shield on the hand ring, when drinking, one can avoid the shield from rotating and contacting his own face.

The environmentally-friendly, anti-contamination suction-nozzle beverage cup cover of the present invention, characterized in that processing steps are as follows:

① for the processing of the cover body, using an injection molding machine and an injection molding mold to perform the injection molding of a plastic raw material into the cover body;

② for the processing of the shield, using the injection molding machine and the injection molding mold to perform the injection molding of the plastic raw material into the shield;

③ the processing of the suction nozzle, using a plastic vacuum forming machine and a plastic vacuum forming mold to make a silicone raw material as a suction nozzle;

④ for the processing of the swing sleeve, using the injection molding machine and the injection molding mold to perform the injection molding of the plastic raw material into the swing sleeve;

⑤ for the processing of the cover body, using an injection molding machine and an injection molding mold to perform the injection molding of a plastic raw material into the cover body;

⑥ for the processing of the safety catch, using the injection molding machine and the injection molding mold to perform the injection molding of the plastic raw material into the safety catch;

⑦ for the processing of the small shaft, using a wire material to make the small shaft with a shear mechanism;

⑧ for the preparation of a spring, procuring the spring from a market;

⑨ for assembly, using the suction nozzle and the swing sleeve mounting the suction nozzle in the swing sleeve, connecting one end of the suction nozzle into the tube insertion hole of the mounting chamber of the cup cover, mounting the swing pin of the swing sleeve into the swing hole of the mounting chamber of the cover body, using the small shaft to fix the safety catch and the clamp on the connecting ear of the cover body,

DETAILED DESCRIPTION

Figure 1:
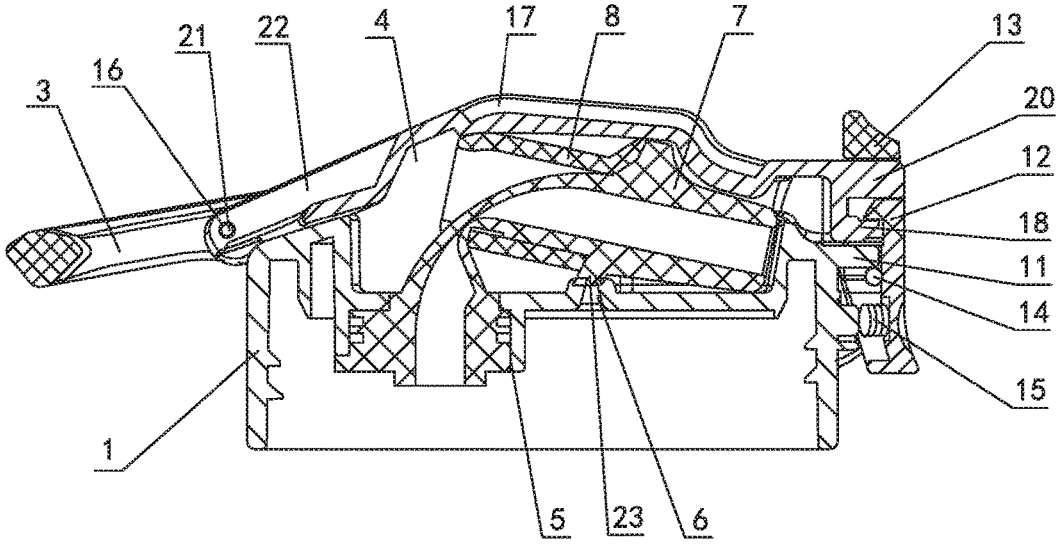
FIG. 1 is a structural diagram of an environmentally-friendly, anti-contamination suction-nozzle beverage cup cover of the present invention.
Figure 2:
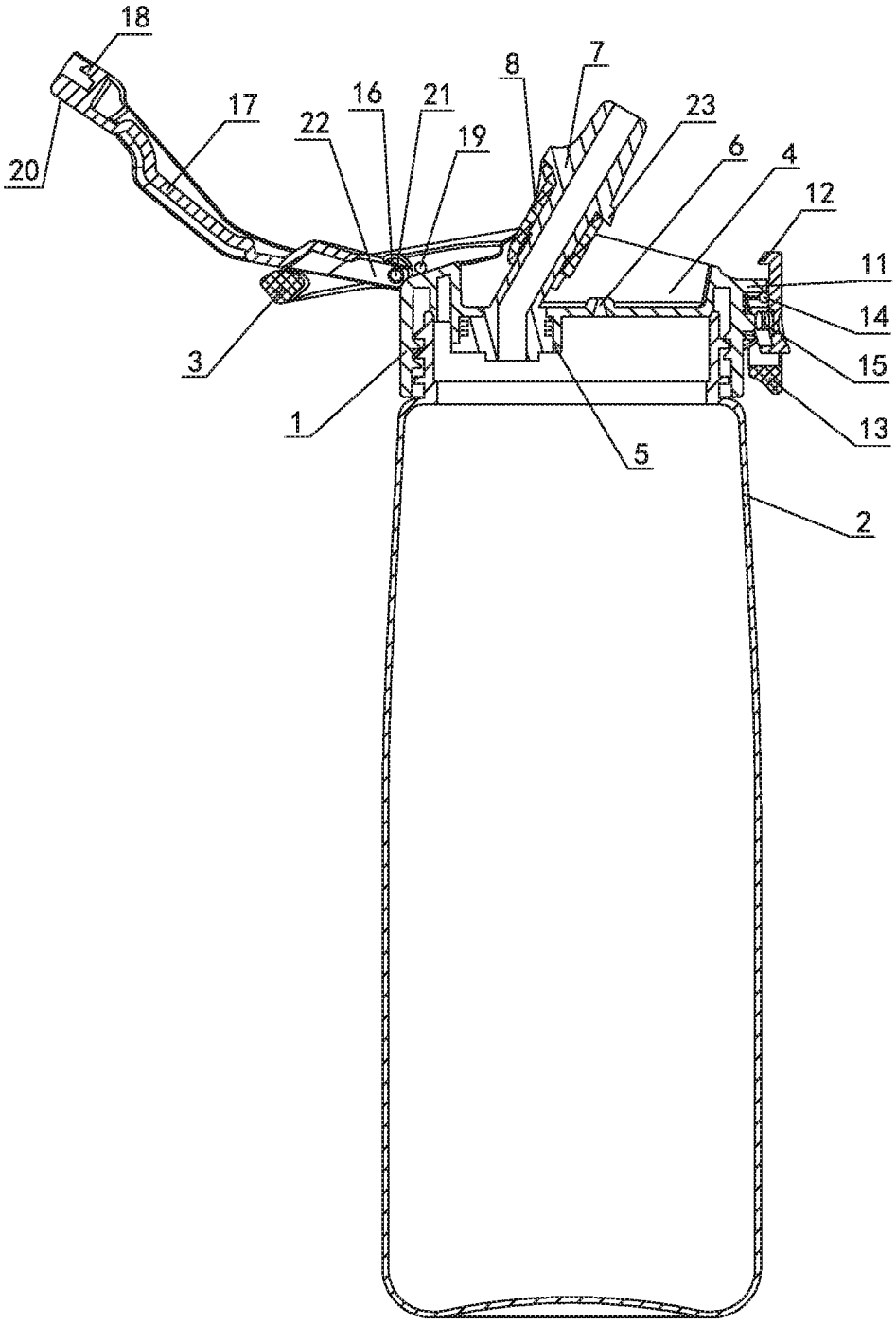
FIG. 2 is a structural diagram when a shield is under an opening state.
Figure 3:
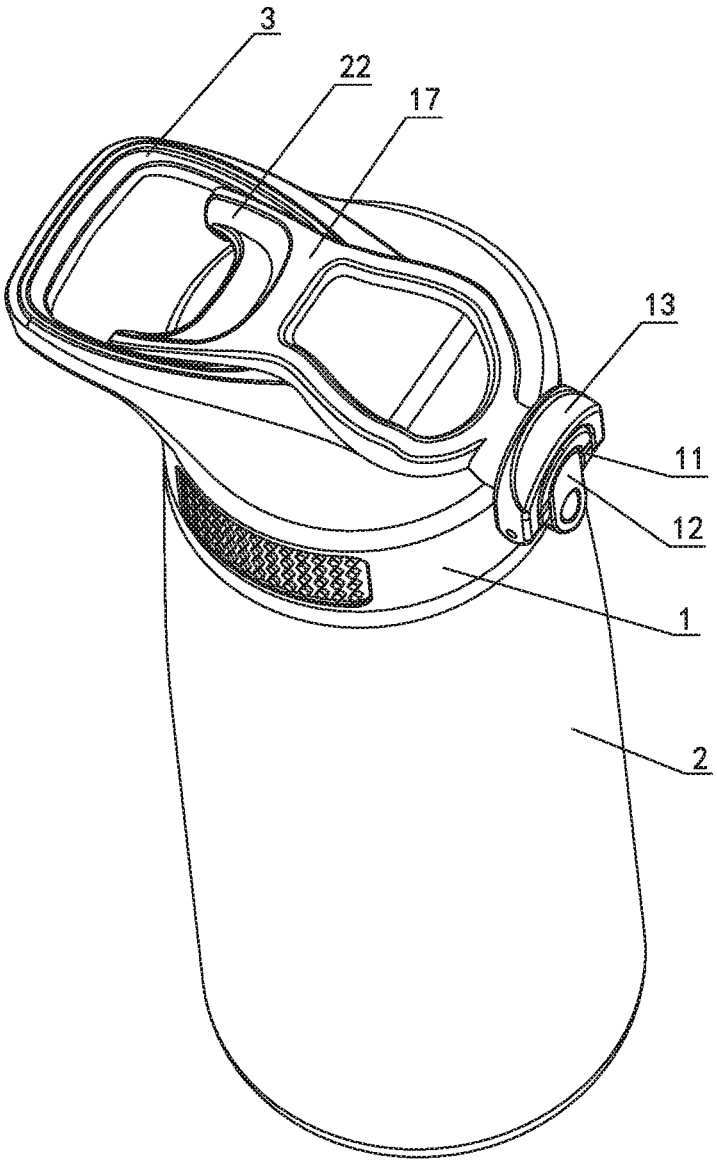
FIG. 3 is a perspective diagram when a shield is under a closing state.
Figure 4:
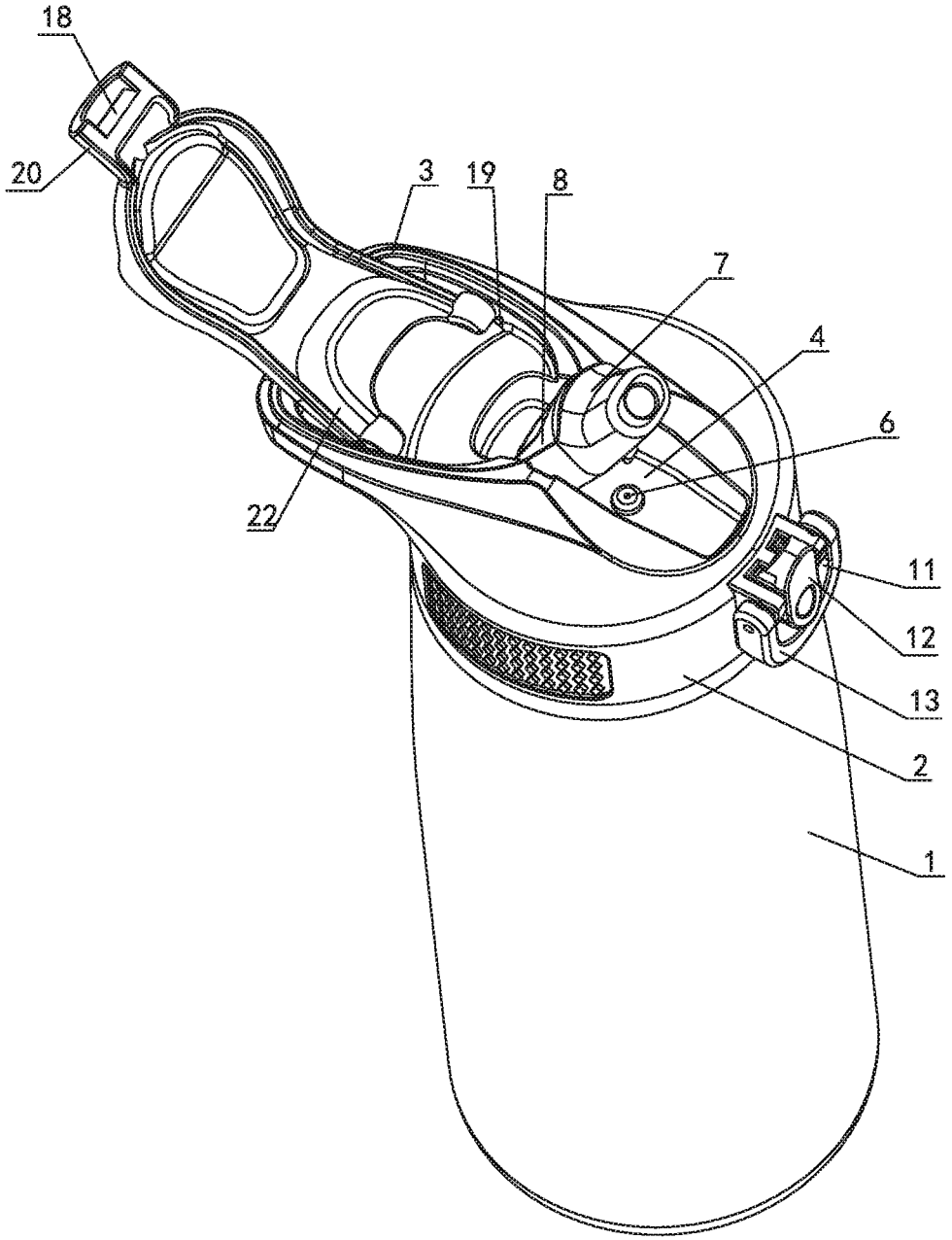
FIG. 4 is a structural diagram when a shield is under an opening state and a suction nozzle is tipped upward.
Figure 5:
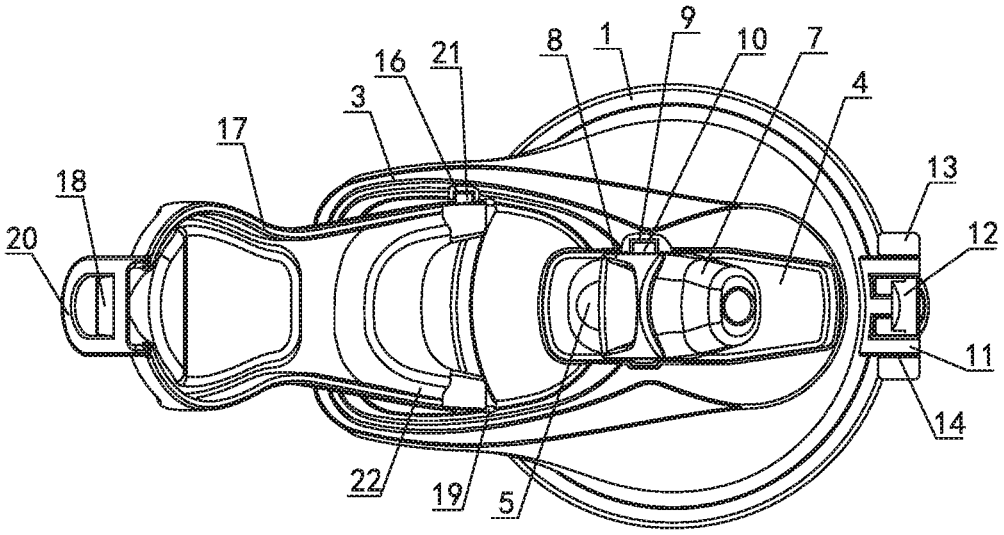
FIG. 5 is a top diagram when a shield is under an opening state.

The present invention relates to an environmentally-friendly, anti-contamination suction-nozzle beverage cup cover, as shown in FIGS. 1-5, the cup cover comprises a cover body 1, with the lower part of the cover body 1 being connected to a beverage cup 2, the cover body is formed with a hand ring 3, the top of the cover body 1 being formed with a suction nozzle mounting chamber 4, a tube insertion hole 5 being formed in the suction nozzle mounting chamber 4, and a suction nozzle 7 being disposed in the tube insertion hole 5, characterized in that a swing sleeve 8 is provided outside the suction nozzle 7 made of silicone, swing holes 9 are formed in both sides of the mounting chamber 4, the swing sleeve 8 is formed with a swing pin 10, the swing pin 10 is fitted into the swing holes 9, a connecting ear 11 is formed at one side of the cover body 1, a clamp 12 and a safety catch 13 are disposed on the connecting ear 11, the clamp 12 and the safety catch 13 are fixed with the connecting ear 11 via a small shaft 14, a return ejector spring 15 is disposed in the clamp 12, a shield 17 is disposed on the cover body 1, a connecting hole is formed on the hand ring 3, two connecting feet are formed at the rear part of the shield 17, a connecting pin 21 is formed on the connecting feet 22, the connecting pin 21 matches the connecting hole 16, the inner wall of the shield 17 is in contact with the head of the suction nozzle, the head 20 of the shield 17 is formed with a clamp rib 18, the clamp rib 18 matches the clamp 12, the safety catch is in contact with the outer wall of the head of the shield 17, an air inlet hole 6 is formed in the suction nozzle mounting chamber 4, the suction nozzle is formed with a tenon 23, the tenon 23 matches the air inlet hole 6. when in use, the safety catch is first is pulled down so that the safety catch and the head of the shield are disengaged, a clamp 12 is pressed, the clamp 12 is subject to a spring force so that the clamp 12 and the clamp rib 18 are disengaged, the elasticity of a silicone suction nozzle 7 is utilized to open the shield 17, the silicone suction nozzle 7 is tipped upward with the swinging of the swinging sleeve 8, one can easily drink the beverage without having to pull his finger up, when finishing the use, one presses with his finger on the outer wall of the shield 17, the shield 17 covers the outside of the silicone suction nozzle 7, the suction nozzle 7 is subject to the pressure of the shield 17, and is pressed into the suction nozzle mounting chamber 4 in the pressing direction of the shield 17, the drinking straw under the suction nozzle 7 is pressed and deformed to be closed, so that the beverage in the beverage cup does not flow out, when the head 20 of the shield 17 is pressed down and in contact with the clamp 12, the clamp 17 is subject to the elastic force of the return ejector spring 15 and blocks the head of the shield 17, the safety catch 13 is fastened, when one does not drink water, he can prevent the shield 17 from being accidentally bounced. when the cup cover is opened and closed, the finger is not in contact with the suction nozzle, this not only facilitates the use, but also avoids the infection of bacteria and achieve the purpose of health and environmental protection. an air inlet hole 6 is formed in the suction nozzle mounting chamber 4, the suction nozzle is formed with a tenon 23, the tenon 23 matches the air inlet hole 6. With the air inlet hole 6, the beverage is easy to flow out when being drunk. a positioning convex piece is formed on the hand ring 3, the positioning convex piece 19 is in contact with the connecting feet 22 of the rear part of the shield 17. after the shield 17 is opened, the positioning convex piece 19 positions and sticks the shield 17 on the hand ring, when drinking, one can avoid the shield 17 from rotating and contacting his own face.

The invention claimed is:

1. An environmentally-friendly, anti-contamination suction-nozzle beverage cup cover, comprising a cover body, with the lower part of the cover body being connected to a beverage cup, the cover body being formed with a hand ring, the top of the cover body being formed with a suction nozzle mounting chamber, a tube insertion hole being formed in the suction nozzle mounting chamber, and a suction nozzle being disposed in the tube insertion hole, characterized in that a swing sleeve is provided outside the suction nozzle made of silicone, swing holes are formed in both sides of the mounting chamber, the swing sleeve is formed with a swing pin, the swing pin is fitted into the swing holes, a connecting ear is formed at one side of the cover body, a clamp and a safety catch are disposed on the connecting ear, the clamp and the safety catch are fixed with the connecting ear via a small shaft, a return ejector spring is disposed in the clamp, a shield is disposed on the cover body, a connecting hole is formed on the hand ring, two connecting feet are formed at the rear part of the shield, a connecting pin is formed on the connecting feet, the connecting pin matches the connecting hole, an inner wall of the shield is in contact with a head of the suction nozzle, a head of the shield is formed with a clamp rib, the clamp rib matches the clamp, the safety catch is in contact with the outer wall of the head of the shield, an air inlet hole is formed in the suction nozzle mounting chamber, the suction nozzle is formed with a tenon, the tenon matches the air inlet hole.

2. The environmentally-friendly, anti-contamination suction-nozzle beverage cup cover according to claim 1, characterized in that a positioning convex piece is formed on the hand ring, the positioning convex piece is in contact with the connecting feet of the rear part of the shield.

3. The environmentally-friendly, anti-contamination suction-nozzle beverage cup cover according to claim 1, characterized in that processing steps are as follows:

1) for the processing of the cover body, using an injection molding machine and an injection molding mold to perform the injection molding of a plastic raw material into the cover body;

2) for the processing of the shield, using the injection molding machine and the injection molding mold to perform the injection molding of the plastic raw material into the shield;

3) for the processing of the suction nozzle, using a plastic vacuum forming machine and a plastic vacuum forming mold to make a silicone raw material as the suction nozzle;

4) for the processing of the swing sleeve, using the injection molding machine and the injection molding mold to perform the injection molding of the plastic raw material into the swing sleeve;

5) for the processing of the cover body, using the injection molding machine and the injection molding mold to perform the injection molding of the plastic raw material into the cover body;

6) for the processing of the safety catch, using the injection molding machine and the injection molding mold to perform the injection molding of the plastic raw material into the safety catch;

7) for the processing of the small shaft, using a wire material to make the small shaft with a shear mechanism;

8) for the preparation of the spring, procuring the spring from a market; 9) for assembly, using the suction nozzle and the swing sleeve mounting the suction nozzle in the swing sleeve, inserting one end of the suction nozzle into the tube insertion hole of the suction nozzle mounting chamber, mounting the swing pin of the swing sleeve into the swing hole of the suction nozzle mounting chamber, using the small shaft to fix the safety catch and the clamp on the connecting ear of the cover body, and finally using the shield, inserting the connecting pin on two connecting feet of the shield into the connecting hole on the hand ring.

* * * * *